US006189629B1

(12) United States Patent
McLeod et al.

(10) Patent No.: US 6,189,629 B1
(45) Date of Patent: Feb. 20, 2001

(54) LATERAL JET DRILLING SYSTEM

(76) Inventors: Roderick D. McLeod, 5104 - 125 Street, Edmonton, Alberta (CA), T6H 3V5; Dwight N. Loree, 758 Woodpark Road S.W., Calgary, Alberta (CA), T2W 2S4

( * ) Notice: Under 35 U.S.C. 154(b), the term of this patent shall be extended for 0 days.

(21) Appl. No.: 09/153,089

(22) Filed: Sep. 14, 1998

(30) Foreign Application Priority Data

Aug. 28, 1998 (CA) ..... 2246040

(51) Int. Cl.[7] ..... E21B 7/08
(52) U.S. Cl. ..... 175/67; 175/79; 175/321
(58) Field of Search ..... 175/67, 61, 62, 175/73, 75, 80, 79, 81, 321

(56) References Cited

U.S. PATENT DOCUMENTS

| | | | |
|---|---|---|---|
| Re. 29,021 | 11/1976 | Archibald et al. | 175/213 |
| Re. 33,660 | 8/1991 | Jelsma | 175/107 |
| 1,367,042 | 2/1921 | Granville . | |
| 1,485,615 | 3/1924 | Jones . | |
| 1,733,311 | 10/1929 | McNeill . | |
| 2,018,285 | 10/1935 | Schweitzer et al. | 166/21 |
| 2,065,436 | 12/1936 | Ervin | 255/71 |
| 2,251,916 | 8/1941 | Cross | 262/3 |
| 2,258,001 | 10/1941 | Chamberlain | 255/1 |
| 2,271,005 | 1/1942 | Grebe | 255/1.8 |
| 2,345,816 | 4/1944 | Hays | 255/1.6 |
| 2,608,384 | 8/1952 | Alexander | 255/1.6 |
| 2,707,616 | 5/1955 | Schad et al. | 255/1 |
| 2,758,653 | 8/1956 | Desbrow | 166/73 |
| 2,796,129 | 6/1957 | Brandon | 166/9 |
| 2,838,117 | 6/1958 | Clark, Jr. et al. | 166/42 |
| 3,130,786 | 4/1964 | Brown et al. | 166/55 |
| 3,145,776 | 8/1964 | Pittman | 166/55 |
| 3,191,697 | 6/1965 | Haines | 175/81 |
| 3,262,508 | 7/1966 | Price | 175/207 |
| 3,536,151 | 10/1970 | Aarup | 175/422 |

(List continued on next page.)

FOREIGN PATENT DOCUMENTS

| | | | |
|---|---|---|---|
| 2090306 | 12/1996 | (CA) | E21B/43/22 |
| 2141111 | 3/1997 | (CA) | E21B/43/22 |
| 2131195 | 4/1997 | (CA) | E21B/43/25 |

OTHER PUBLICATIONS

Abstract of U.S. patent No. 4,051,908, Driver, issued Oct. 4, 1977, 2 pages.

U.S. application No. 08/852,384, filed May 7, 1997, 25 pages, corresponding to a photocopy of Canadian patent application No. 2,189,610, filed Nov. 5, 1996, (published May 5, 1998), including copy of filing certificate.

A photocopy of PCT international application No. PCT/CA94/00109, filed Feb. 24, 1994, (published Sep. 1, 1994), 27 pages.

A photocopy of PCT international application No. PCT/US94/10892, filed Sep. 26, 1994, (published Apr. 13, 1995), 24 pages.

*Primary Examiner*—Frank Tsay
(74) *Attorney, Agent, or Firm*—Ken J. Pedersen; Barbara S. Pedersen

(57) ABSTRACT

In the field of drilling lateral channels from the cased bore of an oil well, a system is presented whereby a number of lateral channels can be drilled through the casing and out a distance into the formation with no requirement to move or raise the lateral drilling apparatus to the surface for each lateral channel drilled. The direction of the drilled lateral channel can be selected by the system operator at the well head. The system will allow the drilling of lateral channels with the well under pressure. A configuration is shown which will allow the installation of a flexible perforated liner in the channel, which flexible perforated liner will prevent the material around the channel from collapsing.

20 Claims, 6 Drawing Sheets

U.S. PATENT DOCUMENTS

| | | | |
|---|---|---|---|
| 3,670,831 | 6/1972 | Winter, Jr. et al. | 175/52 |
| 3,838,736 | 10/1974 | Driver | 166/299 |
| 3,840,079 | 10/1974 | Williamson | 175/61 |
| 3,853,185 | 12/1974 | Dahl et al. | 175/45 |
| 3,873,156 | 3/1975 | Jacoby | 299/4 |
| 3,958,649 | 5/1976 | Bull et al. | 175/61 |
| 4,007,797 | 2/1977 | Jeter | 175/26 |
| 4,050,529 | 9/1977 | Tagirov et al. | 175/422 |
| 4,134,453 | 1/1979 | Love et al. | 166/298 |
| 4,168,752 | 9/1979 | Sabol | 175/12 |
| 4,185,705 | 1/1980 | Bullard | 175/78 |
| 4,317,492 | 3/1982 | Summers et al. | 175/79 |
| 4,365,676 | 12/1982 | Boyadjieff et al. | 175/61 |
| 4,368,786 | 1/1983 | Cousins | 175/78 |
| 4,397,360 | 8/1983 | Schmidt | 175/61 |
| 4,402,551 | 9/1983 | Wood et al. | 299/5 |
| 4,445,574 | 5/1984 | Vann | 166/268 |
| 4,526,242 | 7/1985 | Mathieü et al. | 175/94 |
| 4,527,639 | 7/1985 | Dickinson, III et al. | 175/61 |
| 4,533,182 | 8/1985 | Richards | 299/2 |
| 4,589,499 | 5/1986 | Behrens | 173/22 |
| 4,601,353 | 7/1986 | Schuh et al. | 175/41 |
| 4,631,136 | 12/1986 | Jones, III | 252/8.5 M |
| 4,640,362 | 2/1987 | Schellstede | 166/298 |
| 4,693,327 | 9/1987 | Dickinson et al. | 175/61 |
| 4,739,843 | 4/1988 | Burton | 175/73 |
| 4,763,734 | 8/1988 | Dickinson et al. | 175/61 |
| 4,832,143 | 5/1989 | Kaalstad et al. | 175/365 |
| 4,832,552 | 5/1989 | Skelly | 414/22.54 |
| 4,836,611 | 6/1989 | El-Saie | 299/7 |
| 4,848,486 | 7/1989 | Bodine | 175/55 |
| 4,850,440 | 7/1989 | Smet | 175/67 |
| 4,854,400 | 8/1989 | Simpson | 175/85 |
| 4,890,681 | 1/1990 | Skelly | 173/163 |
| 4,974,672 | 12/1990 | Dickinson et al. | 166/55.1 |
| 5,090,496 | 2/1992 | Walker | 175/61 |
| 5,113,953 | 5/1992 | Noble | 175/61 |
| 5,148,877 | 9/1992 | MacGregor | 175/79 |
| 5,148,880 | 9/1992 | Lee et al. | 175/393 |
| 5,165,491 | 11/1992 | Wilson | 175/62 |
| 5,183,111 | 2/1993 | Schellstede | 166/298 |
| 5,230,386 | 7/1993 | Wu et al. | 175/45 |
| 5,249,628 | 10/1993 | Surjaatmadja | 166/308 |
| 5,265,687 | 11/1993 | Gray | 175/62 |
| 5,318,121 | 6/1994 | Brockman et al. | 166/313 |
| 5,373,906 | 12/1994 | Braddick | 175/67 |
| 5,392,858 | 2/1995 | Peters et al. | 166/298 |
| 5,413,184 | 5/1995 | Landers | 175/62 |
| 5,439,066 | 8/1995 | Gipson | 175/61 |
| 5,499,679 | 3/1996 | Loree | 166/308 |
| 5,513,713 | 5/1996 | Groves | 175/73 |
| 5,515,923 | 5/1996 | Loree | 166/308 |
| 5,853,056 | 12/1998 | Landers | 175/424 |

LATERAL JET DRILLING SYSTEM

FIELD OF THE INVENTION

This invention relates to equipment used for drilling lateral channels into an oil or gas bearing formation of a well with the well either under pressure or not under pressure.

BACKGROUND OF THE INVENTION

Over the past twenty years a multitude of proposals have been put forth for drilling lateral channels into hydrocarbon bearing formations encountered in a well which has a vertical steel casing installed in it. Schellstede U.S. Pat. No. 4,640,362, Schellstede U.S. Pat. No. 5,183,111, Dickinson U.S. Pat. No. 4,527,639, Landers U.S. Pat. No. 5,413,184, Peters U.S. Pat. No. 5,392,858, rely on the casing being firstly perforated with a tool of some type, ranging from a punch in Schellstede U.S. Pat. No. 4,640,362 to a drill bit in Landers U.S. Pat. No. 5,413,184. After the hole is made in the casing, a water jet head and its connection hose, which is used to make a lateral channel in the formation, is moved out into the formation while water mixed with appropriate chemicals is pumped through the hose and jet head. The water is pumped down the well to the hose through small diameter tubing. The action of the jet on the formation erodes the formation and produces a lateral channel from the steel casing to the extent that the hose and jet head will reach. The jet head configurations have a jet or jets facing forward to erode material and jets facing rearward to help move the jet head and its connecting hose or pipe into the formation. The rearward facing jets also flush the eroded material back inside the well casing. Jets have been used in industry for many years for cleaning boiler tubes and other blocked and corrosion reduced diameters of tubes in refinery process equipment. There is a multitude of such jet head configurations on the market and their use for drilling wells, including lateral wells, is not new.

There are also available jet perforating systems which are positioned in a casing where it is required to bore through to the formation and such jets are supplied with fluid and an abrasive under high pressure and volume, which erodes a hole in the casing. These systems have been in use for over twenty-five years and are well known in the industry but are not the method of choice for the large majority of perforating services.

All of the various lateral jet drilling devices require that a hole be made in the casing for the jet head and hose to go through to get into the formation where the jet will drill the lateral channel. The main difference in the systems is how the hole is made in the casing. For each lateral channel, the jet head and hose must either be removed from the tool head and the drill system moved in and actuated or some mechanism must move the tool up or down in the casing to get the drilling device in place. There is also no provision for installing a casing in the lateral channel that will keep the channel from collapsing after the drilling is complete.

In order to drill several holes at different angles around the casing, a large number of runs of this type of equipment will be required. The various systems designed require that there be large tubing run in the well in order to house and support the various devices. This type of system requires a service rig on site to initially lower the equipment in the well. Reliance on tubing rotation (Landers U.S. Pat. No. 5,413,184) in order to orient the lateral holes being drilled in the formation is prone to error due to the tubing not rotating the same number of degrees at the bottom as it has been turned at the top. It is known that in wells that have not been drilled straight that the friction of the tubing on the casing can restrain the tool at the bottom from turning at all while the tubing at the top rotates a full turn. The accurate depth positioning of these tools in the well is also questionable. Typically, the position of the tool in the well is calculated by measuring the length of tubing that is run in the well and comparing this against electric well logging, wherein the well logging cable footage is recorded to the exact depth. The depth is also confirmed by counting casing collars.

SUMMARY OF THE INVENTION

There is therefore provided in accordance with one aspect of the invention, an orientable jet drilling apparatus, comprising an upper anchorable body and a lower rotatable body carried by the upper anchorable body, with the lower rotatable body being rotated under control of a motor mounted in the upper anchorable body. The motor is controlled by controller at the surface connected to the motor via a communications link.

In a further aspect of the invention, there is provided the orientable jet drilling apparatus with a jet drilling hose received by the upper and lower bodies, a fluid supply line connected to the jet drilling hose, the fluid supply line being carried by a powered hose reel and a pump operably connected to the fluid supply line for pumping fluid to the jet drilling hose.

In a further aspect of the invention, the anchoring system comprises laterally movable dogs disposed in the upper body, a dogs driver in the upper body; and a control line running to the surface for surface control of the laterally movable dogs.

In a further aspect of the invention, there is provided a vertical position sensor mounted on one of the upper body and the lower body.

In a further aspect of the invention, there is provided a jet drilling system, comprising casing in a well, a wellhead connected to the casing, the wellhead being configured for pressure containment, a downhole jet orientation tool comprising an upper body housing having an anchoring system and a first hose channel passing through the upper body, and a lower body having a second hose channel extending through the lower body and forming an angled elbow, a jet drilling hose received within the first and second hose channels, a fluid supply line connected to the jet drilling hose, the fluid supply line being carried by a powered hose reel, and a pump operably connected to the fluid supply line for pumping fluid to the jet drilling hose.

In a further aspect of the invention, there is provided a jet drilling device, which has a jet drilling hose having a downhole end, a jet head on the downhole end of the jet drilling hose, and a flexible perforated liner carried by the jet drilling hose. The flexible perforated liner may be secured on the hose by shoulders at opposed ends of the flexible perforated liner which engage with shoulders on the jet head.

In a further aspect of the invention, the wellhead comprises a valve connected above the casing, and grease injectors at the top of the wellhead which receives any lines passing up out of the wellhead.

In a further aspect of the invention, there is provided a method of drilling lateral wells from a main well, the method comprising the steps of:

locating an orientable jet drilling apparatus in a well, the orientable jet drilling apparatus having an angled elbow for directing a jet drilling head laterally from the orientable jet drilling apparatus;

drilling a first lateral well at a first radial position with the orientable jet drilling apparatus;

rotating the orientable jet drilling apparatus with a motor mounted on the orientable jet drilling apparatus to a second radial position; and drilling a second lateral well at the second radial position.

In a further aspect of the method of the invention, there is provided the steps of while drilling a lateral well, pulling a flexible perforated liner into the lateral well with the jet drilling head, and while removing the jet drilling head from the lateral well, leaving a portion of the flexible perforated liner in the lateral well after completion of the lateral well.

In a further aspect of the method of the invention, there is provided the step of shearing the flexible perforated liner by rotating the orientable jet drilling apparatus to cut off the portion of the flexible perforated liner in the lateral well.

The orientable jet drilling apparatus may thus, according to one embodiment, be located in the well using a casing collar locator. The invention thus provides a device that may be installed without the necessity of running large tubing in the well. Using a stepping motor for orienting the orientable jet drilling device allows the radial position of the lateral holes to be accurately set by signals from a controller at the surface. When pressure containment is used, the system allows jet drilling to proceed under both controlled well pressure conditions and neutral pressure.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In general terms, the lateral jet drilling tool described herein comprises a tool which is lowered into the well casing as for example by a cable, which cable preferably also houses electrical conductors. A flexible hose with a jetting nozzle and a small diameter fluid supply tubing is also installed with the tool, preferably with the jetting nozzle carrying a perforated flexible liner. The tool is preferably stationed in the well by setting anchors in the casing at a depth which has been accurately calculated by both an above ground cable footage counter and an included casing collar counter. Fluid with a required abrasive is pumped to the jet head, which erodes a hole through the steel casing. The flexible hose with the jet head, and preferably also the flexible liner, is then advanced into the formation where only water or other suitable fluid is pumped to the jet head to erode the formation. Fluids believed to have particular utility in the implementation of the invention include water, carbon dioxide, nitrogen, and hydrocarbons, for example alkanes, such as propane and ethane, and also aromatics, fluids containing a mixture of aromatics and alkanes, and crude oil. Water may be formation damaging, particularly when the formation includes clays. It is desirable to choose a formation compatible fluid. Frequently, this will mean carbon dioxide, hydrocarbon fluids and miscible mixtures of carbon dioxide and hydrocarbon fluids will be suitable. Fluids with a high aromatic content, or containing a complex mixture of aromatics are also believed to be particularly useful.

When a suitable length of channel has been made, the hose and jet head are retracted into the tool by the action of the tubing reel at the operator's position, and the liner left in place (if it is used). The tool is then indexed to the next radial position in the casing and the jetting process repeated. When the tool is indexed to the next radial position, if a liner is used, this will cut off the liner at the surface of the tool. The part of the liner in the tool may be retrieved, and when the jetting process is repeated a new section of liner can be used.

If there is a second level of lateral channels to be drilled, the tool is un-anchored from the casing, moved to the new location and reset. The inclusion in this system of a blow out preventer and grease injectors on the well head allow the jet system to work under well pressure and in the under balance condition encountered in many of the newly drilled wells. The system will of course work when there is no pressure in the well.

Figure 1:
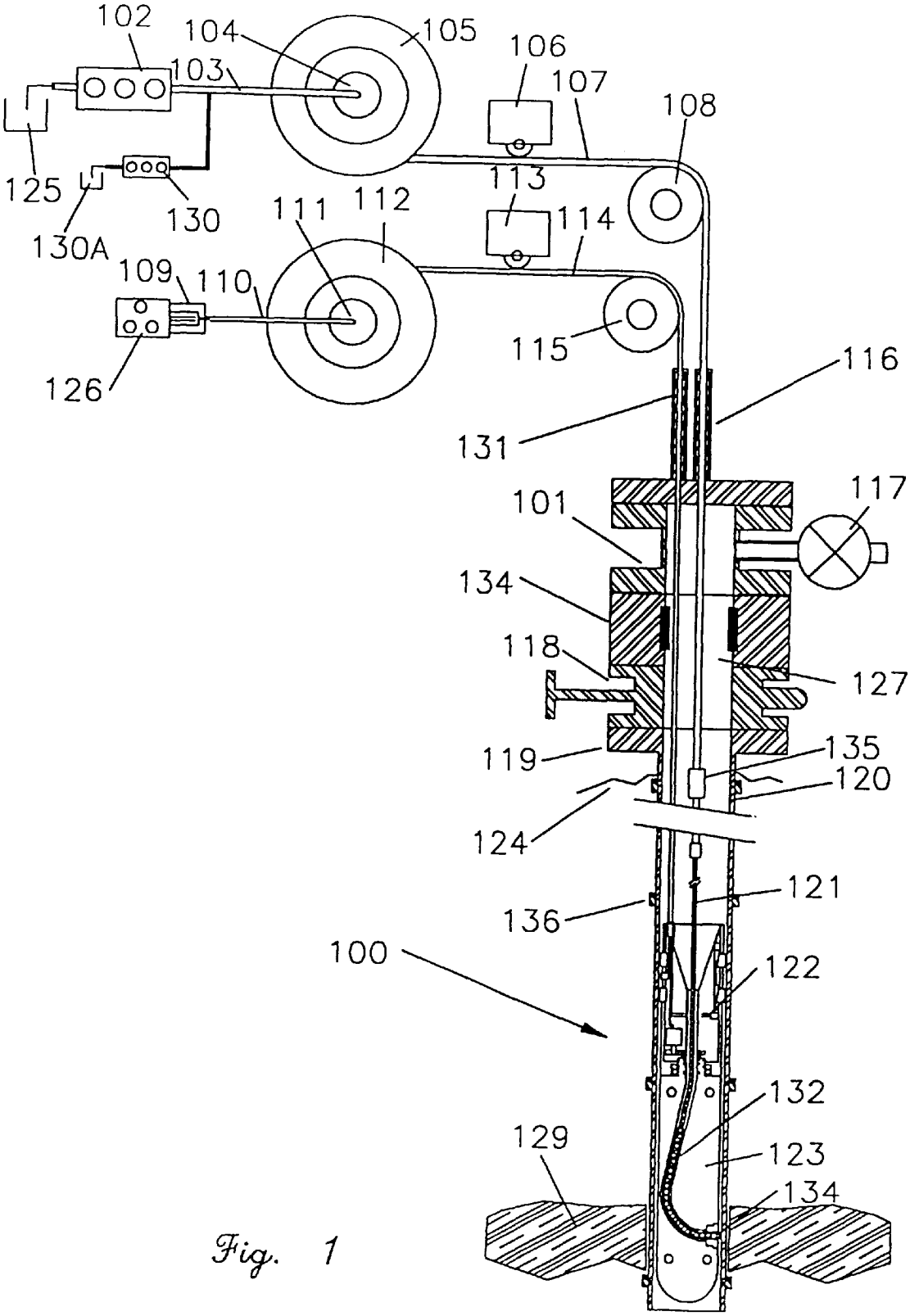
FIG. 1 is a circular section of the tool in position in the well casing with the associated cable and fluid tubing shown leading from the tool up through the well head equipment to the operating and control equipment shown schematically at the well head.

FIG. 1 illustrates a downhole jet orientation tool 100, which is formed of an upper body 122 and rotatable lower body 123 in position in a well casing 120 with casing collars 136 where a jet nozzle 134 is in position adjacent to formation 129. The construction of the flexible hose is well known in the art. For example, the flexible hose may be a Gates™ high pressure hydraulic hose or a Kevlar™ hydraulic hose. The construction of jet heads with various configurations of jets is also known in the art and need not be further described. Flexible hose 121 is affixed with stop attachment 135 to the fluid supply line 107 which runs up the well casing to ground level 124, through a wellhead pressure containment device comprising a casing flange 119, well head valve 118 which is connected via the casing flange 119 to the casing, blowout preventer 132 above the wellhead valve 118, spacer 101 above the blowout preventer 132 with outlet valve 117 and grease injectors 131 and 116 at the top of the wellhead. A flexible perforated liner (liner) 132 is carried by the nozzle 134 and hose 121. The well head valve 118, blowout preventer 312, spacer 101, and outlet valve 117 are all conventional oil well equipment and need not be further described. The fluid supply line 107 passes through grease injector 116, over pulley 108, past fluid supply line counter 106 and onto powered hose reel 105. Fluid 125 is pumped by pump 102 through line 103 to rotary fitting 104 into the fluid supply line on the reel.

Control cable 114 runs from the upper body 122, through the well head valve 118, blowout preventer 132, spacer 101 and grease injector 131 over the pulley 115, past the cable counter 114 to the cable reel 112. Control cable 114 acts as a communication link between control station 126 and downhole motor 203. Downhole motor 203 may be any of various conventional electrical stepping motors or other suitable motor. The internal control cable wires 109 run through the collector 111 and the line 110 to the control station 126. Pressure inside the well head and the casing is shown at 127. A sinker bar 133 is provided on the fluid supply line. The pump 130 is supplied with additives at 130A and is connected to pump fluid into the line 103.

Figure 2:
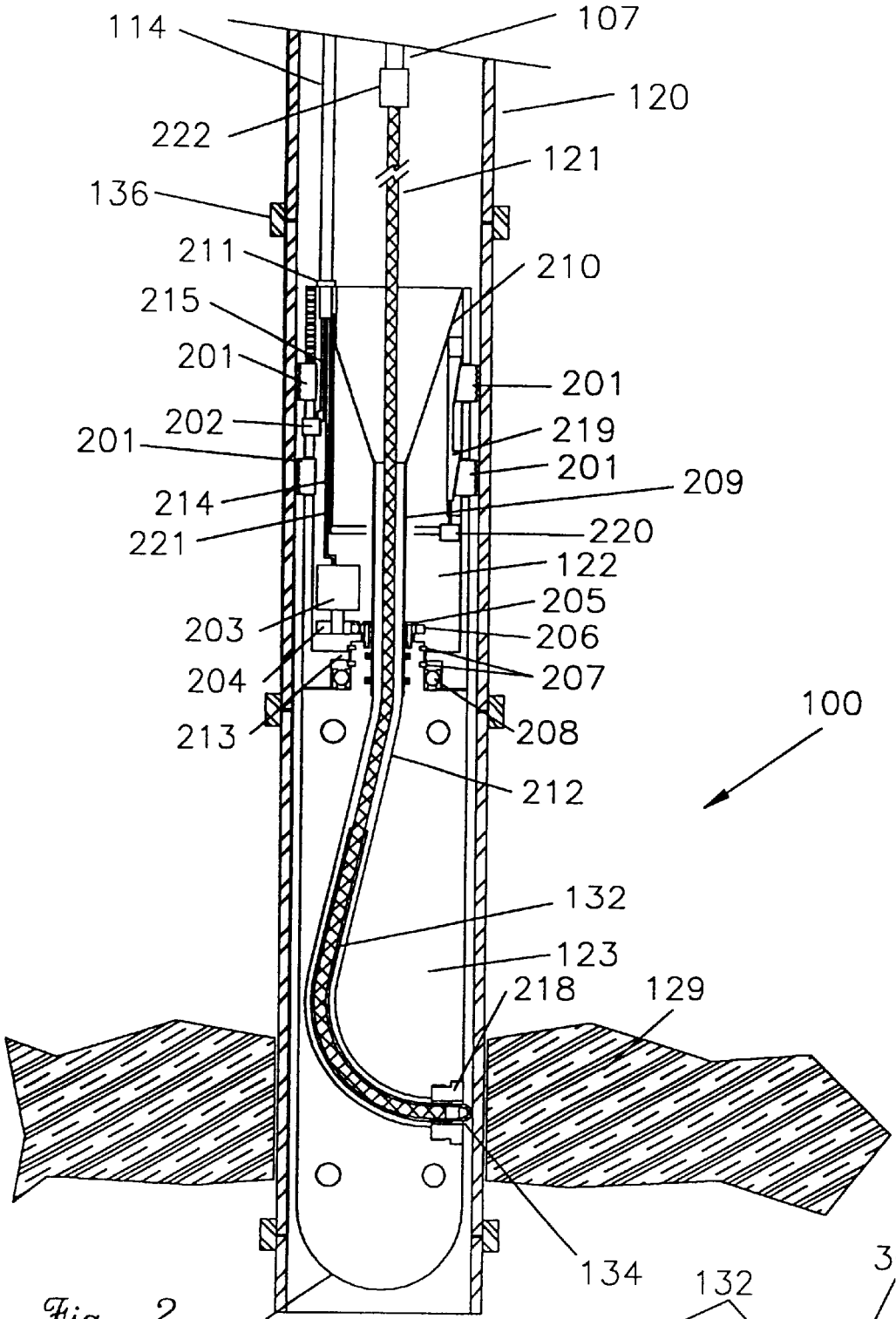
FIG. 2 is a circular cross section of the casing, tool and formation with the jet head in position to start jetting through the casing.

Referring to FIG. 2, there is illustrated upper body 122, with lower body 123 rotatably attached to the upper body 122 by shoulder 213 on upper body 123. Shoulder 213 is received by circlips 207 with bearing 208 sitting between the upper body 122 and lower body 123. Passing through the upper body 122 and lower body 123 are upper portion 209 and lower portion 212 of a hose channel. The lower portion of the hose channel 212 forms an angled elbow, which directs the hose laterally in the well. The angle of the terminal part of the hose channel 212 as it exits the lower body 123 is not critical, but is preferably at a right angle to the axis of the lower body. Upper face 210 of the upper body 122 is concave with a conical shape for directing the hose 121 into the hose channel 212. In the lower body 123 is shown a jet blast wear fitting 218 surrounding the place where hose channel 212 exits the lower body 123 approximately at right angles to the central axis of the lower body 123. This fitting 218 is a body of hardened metal which acts as a shield against fluid from the jet heads, and thus helps to stop splash back of drilling fluids penetrating the metal of the lower body 123. The shield may be any suitable shape and secured by any suitable means in the lower body 123. The shield 218 also functions to shear the liner 132 upon rotation of the lower body 123 when the liner 132 is in place in the formation and extending into the lower body 123. The liner 132 may be sheared by rotation of the lower body 123, or may be sheared by a cutting device (not shown) mounted on the tool 100.

In the upper body 122 is an anchor formed by laterally movable casing dogs 201. Casing dogs 201 are activated by downward axial movement of slides 219. The slides 219 are driven by slide operating solenoid 220 which has its control wires 221 running to control cable 109. The control cable 109 is connected to the upper body at 211 by a conventional fitting. A conventional casing collar locator 202 is also connected to the control cable 109. Affixed to the lower body by bolts 205 is a gear 206. This gear 206 is in mesh with gear 204, which is affixed to the shaft of index motor 203. Control wires 214 connect the index motor to the control cable 109.

Figure 3:
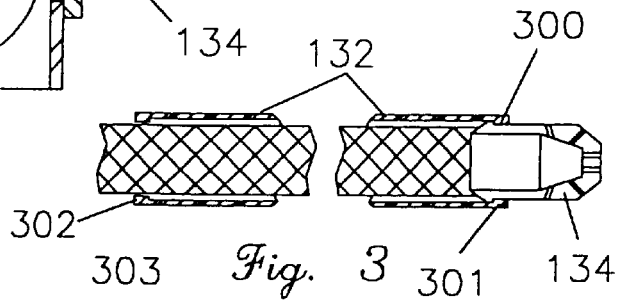
FIG. 3 is an enlarged circular cross section of the jet nozzle, flexible hose and perforated flexible liner.

Referring to FIG. 3, there is illustrated an expanded view of a nozzle 134 with side jets 300, front jets 301 and reverse jets 302. Various nozzles that are known in the art of jet drilling may be used in the implementation of the invention. A shoulder 300 on the jet nozzle is shown engaged with internal shoulder 301 on the forward end of the liner 132 which also features an internal shoulder 302 at its rearward end. The forward and rearward shoulders are a tight fit on the jet head shoulder, but flexible enough to allow for installing the liner on the jet head and hose. A lubricant between the hose and liner is noted at 303.

Figure 4:
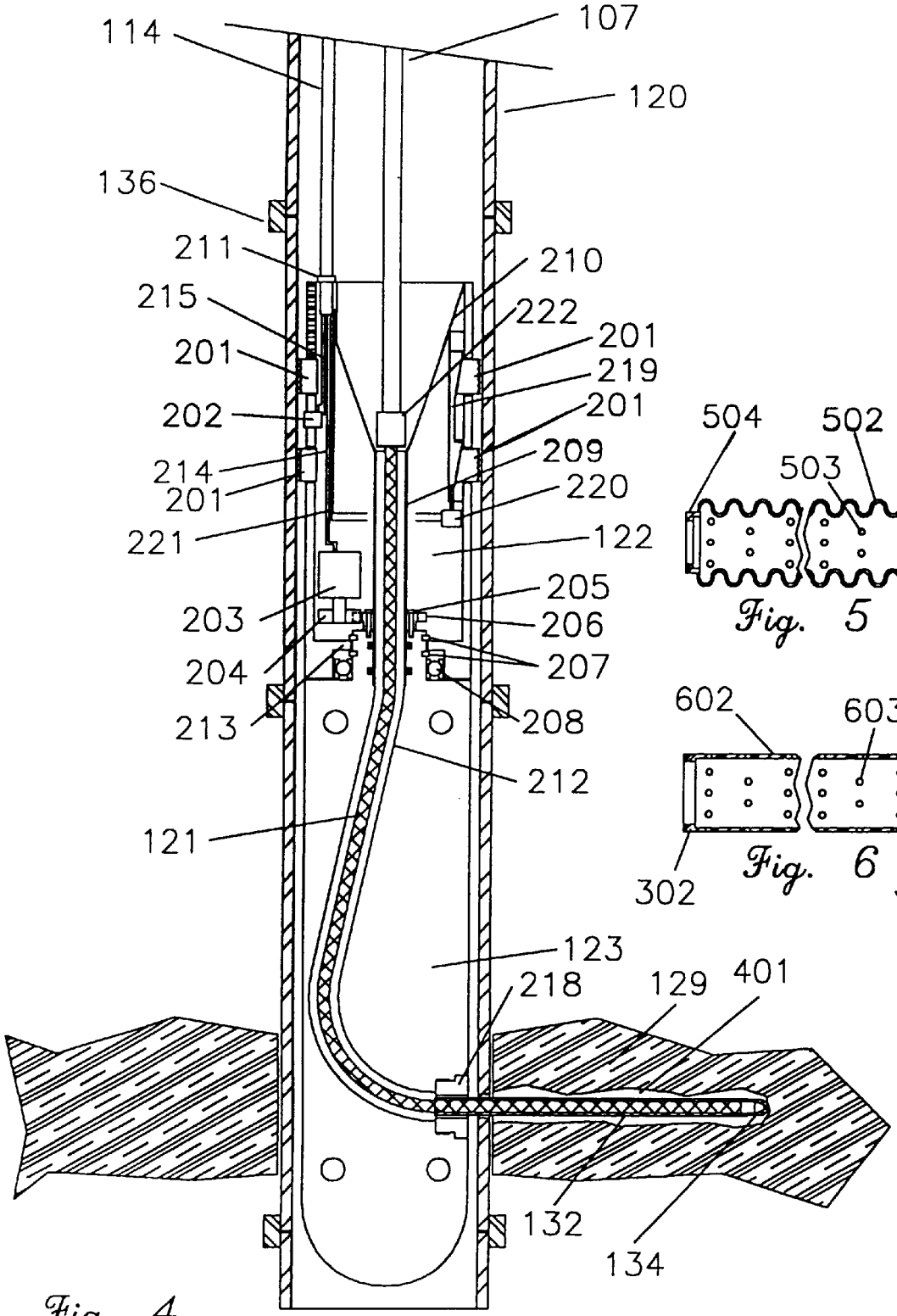
FIG. 4 is a circular cross section of the tool with the dogs engaging the casing and the jet head, hose and liner advanced into the formation.

Referring to FIG. 4, there is illustrated casing dogs 201 activated in contact with the casing thus holding the upper body 122 in position. Jet head 134, hose 121 and liner 132 are shown moved out into the formation in position to make a channel 401 in the formation by jet drilling.

Figure 5:
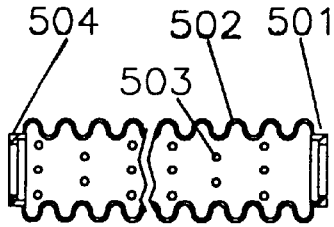
FIG. 5 is a cross section of a corrugated wall material liner.
Figure 6:
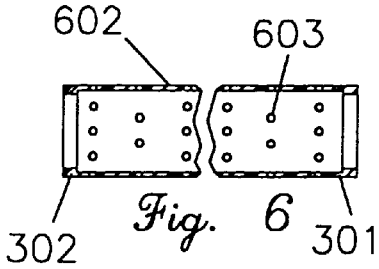
FIG. 6 is a cross section of a smooth walled material liner.

Referring to FIG. 5, there is illustrated a corrugated flexible liner 502 with perforations 503, forward internal shoulder 501 and rearward internal shoulder 504. Referring to FIG. 6, there is illustrated the liner 132 with perforations 603.

Figure 7:
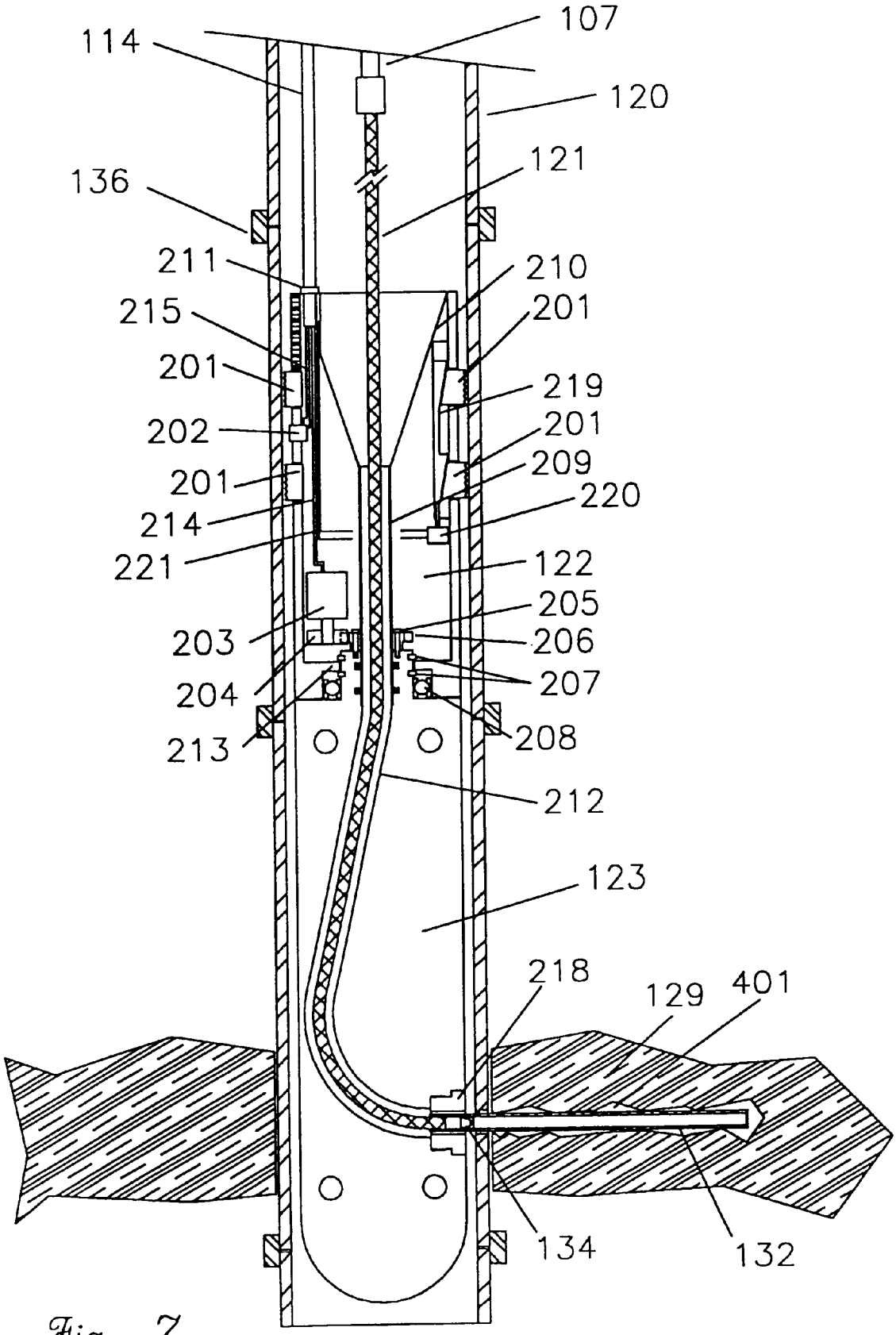
FIG. 7 is a circular cross section of the tool with the jetting hose moved back into position in the tool and leaving a portion of the liner in the channel.

Referring to FIG. 7, there is illustrated the tool 100 after the channel has been drilled and the jet 134 and hose 121 have been moved back to a station inside the lower body 123, leaving the liner 132, which is held in place by friction from the formation, in place in the formation.

Figures 8, 9:
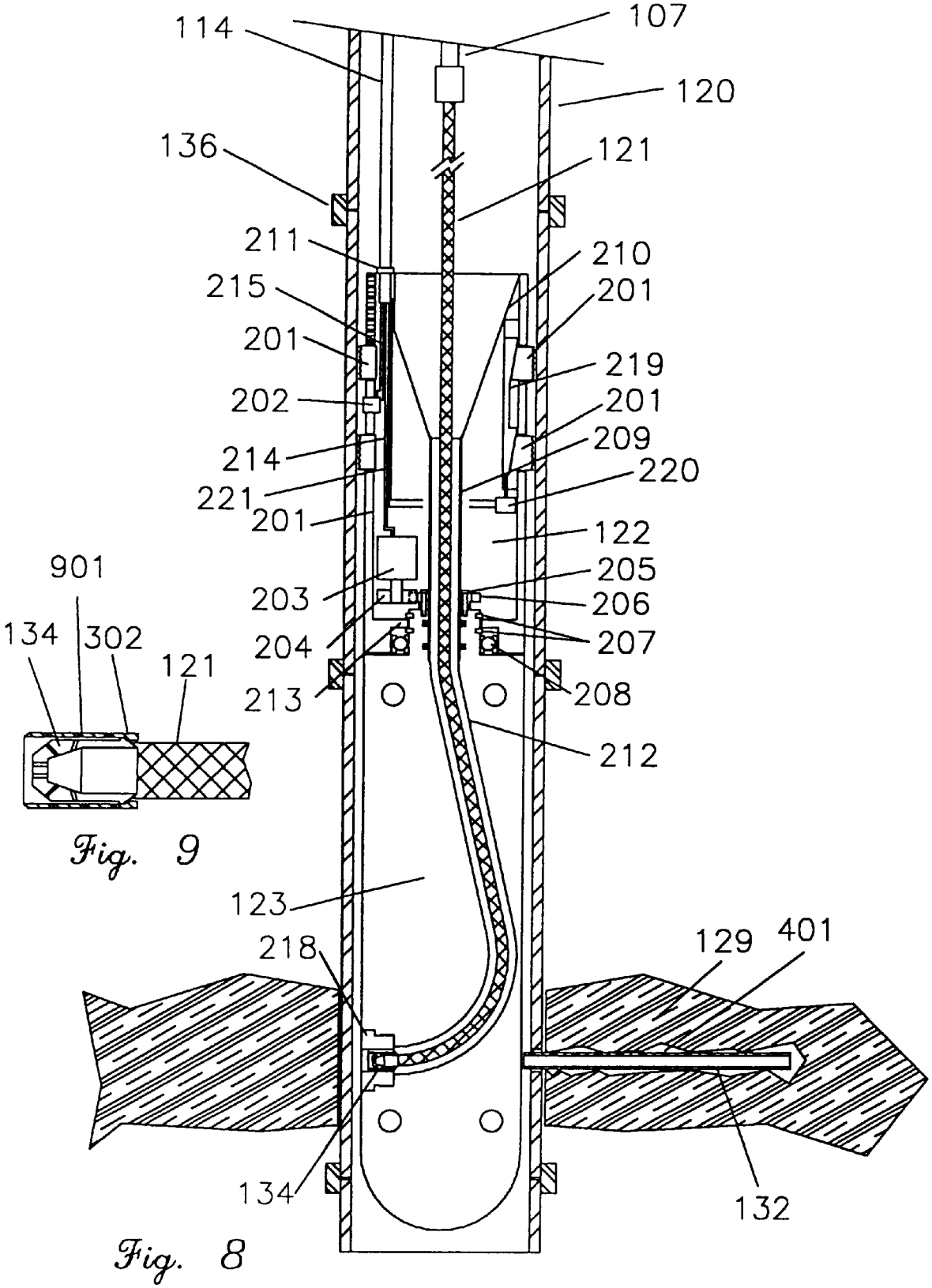
FIG. 8 is a circular cross section of the tool with the jetting hose still in position in the tool after having the rotatable portion indexed through 180 degrees and having the liner sheared off by the rotating action (a portion of the perforated liner is still on the jet head, which is ready to be retrieved to the top of the well)
FIG. 9 is an enlarged cross section of the jet head showing a sheared portion of the liner in place on the jet head.

Referring to FIG. 8, there is illustrated the tool 100 after the rotatable lower body 123 has been rotated by 180 degrees, causing the shearing of the liner 132 by the shearing action of the shear fitting 218 and the casing wall.

Referring to FIG. 9, there is illustrated the jet head 134 and hose 121 with the portion of the liner 901 that has been left held on the jet 134 by the rearward shoulder 302. This portion of the liner 132 may be of any length, depending on the distance that the channel was jet drilled. The hose 121, jet head 134 and liner 132 are now in position to be retrieved to the surface for installation of a new liner.

Figure 10:
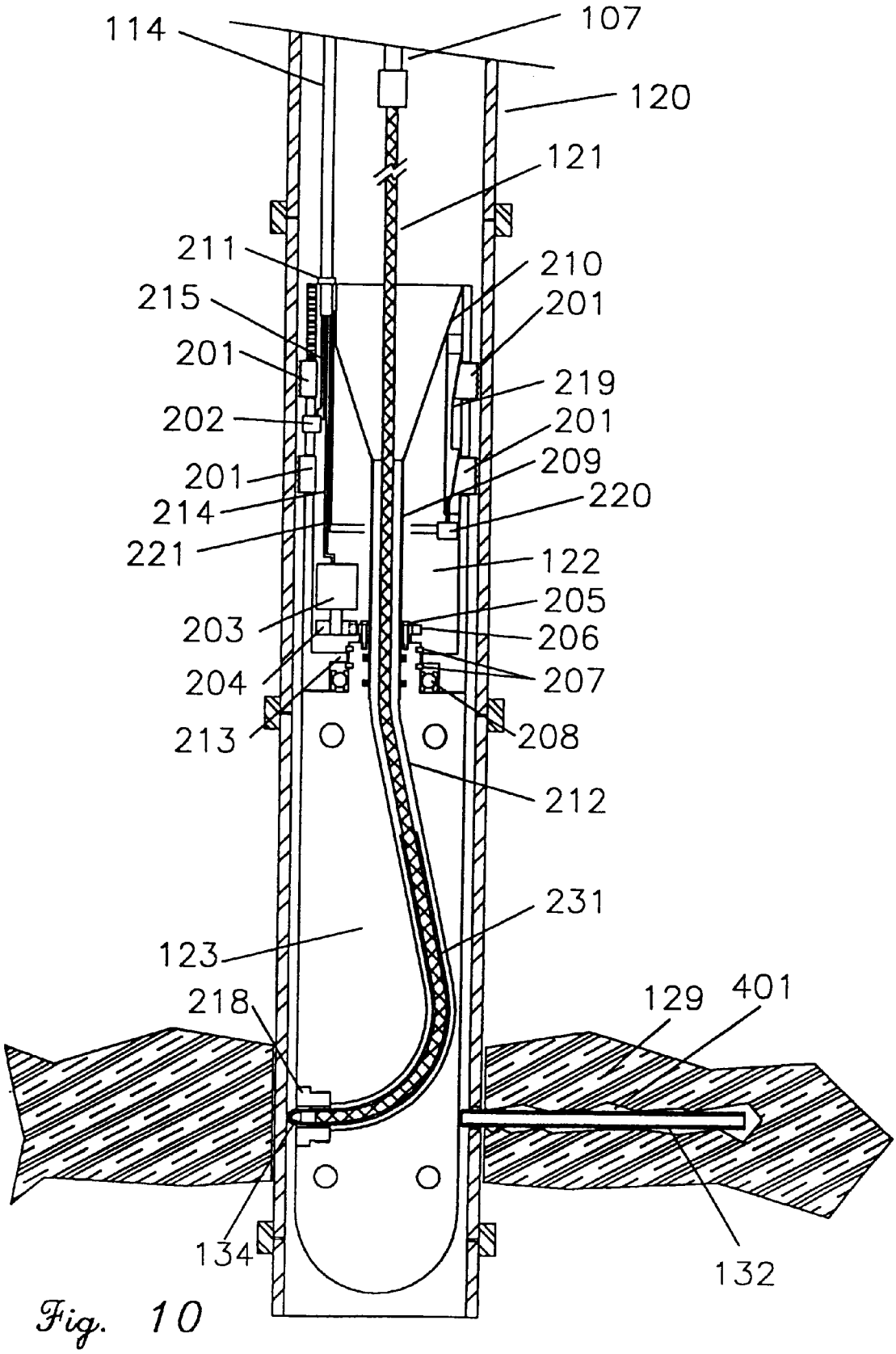
FIG. 10 is a circular cross section of the tool with the jet head, flexible hose and newly installed perforated flexible liner in position to start another jet drilling procedure.

Referring to FIG. 10, there is illustrated the jet head 134, hose 121 and the new liner 121 in place in the tool after being run down from the surface. The jet drilling operation sequence is repeated from this position.

In operation, the tool 100 is initially positioned in the well head through the conventional grease injectors 131 and 116. The tool 100 is lowered to the desired position adjacent to the formation by unreeling the cable reel 105 and the fluid supply line reel 112 in unison. The casing collar locator 202 in the tool 100 sends back a signal to the control station 126 as each casing collar is passed. When the final position has been reached and confirmed with readings from the control cable counters, the fluid supply line counter and the collar locator (each of which forms a vertical position sensor), the casing dogs 201 are activated to anchor the tool loo in position. The fluid supply pump and the additive supply are started and the casing jetting begun. When the hole has been eroded in the casing, the additive pump is stopped and the jet head 112 and hose 121 are allowed to move out into the formation. If formation pressure is encountered at this time, it is enclosed in the well and well head due to the grease injectors 131 and 116 and controlled through the outlet valve 117. When the required length of the channel in the formation has been made, the hose 121 is withdrawn back through the tool 100 by rotation of the fluid supply line reel 105.

The liner 132 will remain in place as the hose 121 and jet head 134 move back through it, held by friction from the formation. When the jet head 134 is inside the lower rotatable body 123, the lower rotatable body 123 is indexed by the operator at the control station and the liner 132 is sheared at the interface of the casing 120 and the shear fitting 218. The length of channel and the length of liner will not always match, so there will be a certain length of liner 132 still held on the hose 121 by the jet head 132. This is now retrieved to the surface by the action of the tubing reel. The hose 121, liner 132 remnant and jet head 134 are taken out of the well head by the usual method involving the grease injector and the blow out preventer and a new liner is installed on the hose 121. The jet head 134, hose 121 and liner 132 are then run into the well again and down to the tool where the jet drilling procedure is commenced.

This is done for as many lateral channels as is required. When the operation is finished, the tool 100 is un-dogged from the casing and either moved vertically to another position in the well casing or taken out.

During the jetting operation it is noted that any well pressure is held in check by the grease injectors 131 and 116 sealing the cable and fluid supply line. The grease injectors need not be described as they are a commonly used item in oil field work. Installation and withdrawal of equipment through the well head valve and blow out preventer is also a standard operation in the oil field and need not be described to anyone familiar with the art.

It is acknowledged that many changes and additions to the equipment and the operation sequences may be made by those skilled in the art, but such changes or additions will not substantially change the described system.

When all that is required is to drill a set of lateral holes from a main well, the direction of drilling of the initial lateral hole is not a matter of concern. The remaining laterals may be drilled at fixed (eg 60°, 90°, 120°) or random radial offsets from the initial lateral. When a set of laterals has been drilled at one vertical position in the well, the tool 100 may be moved to another vertical position and another set of laterals drilled.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. An orientable jet drilling apparatus, comprising:

an upper body housing a downhole motor having a shaft, the upper body having an anchoring system and a first hose channel passing through the upper body;

a lower body having a second hose channel extending through the lower body and forming an angled elbow, the lower body being attached to the upper body for rotation under control of the downhole motor; and a motor controller connected via a communication link to the downhole motor.

2. The jet drilling apparatus of claim 1 further comprising:

a jet drilling hose received within the first and second hose channels, the jet drilling hose having a downhole end;

a jet head on the downhole end of the jet drilling hose;

a fluid supply line connected to the jet drilling hose, the fluid supply line being carried by a powered hose reel; and a pump operably connected to the fluid supply line for pumping fluid to the jet drilling hose.

3. The jet drilling apparatus of claim 2 in which the hose carries a flexible perforated liner.

4. The jet drilling apparatus of claim 3 in which the flexible perforated liner is secured on the hose by shoulders at opposed ends of the flexible perforated liner which engage with shoulders on the jet head.

5. The jet drilling apparatus of claim 2 in which the anchoring system comprises:

laterally movable dogs disposed in the upper body;

a dogs driver in the upper body; and a control line running to the surface for surface control of the laterally movable dogs.

6. The jet drilling apparatus of claim 3 further comprising a vertical position sensor mounted on one of the upper body and the lower body.

7. A jet drilling system, comprising:

casing in a well;

a wellhead connected to the casing, the wellhead being configured for pressure containment;

a downhole jet orientation tool comprising an upper body housing having an anchoring system and a first hose channel passing through the upper body, and a lower body having a second hose channel extending through the lower body and forming an angled elbow, the lower body being capable of rotation with respect to the upper body;

a jet drilling hose received within the first and second hose channels, the jet drilling hose having a downhole end;

a jet head on the downhole end of the jet drilling hose;

a fluid supply line connected to the jet drilling hose, the fluid supply line being carried by a powered hose reel; and, a pump operably connected to the fluid supply line for pumping fluid to the jet drilling hose.

8. The jet drilling system of claim 7 in which the wellhead comprises a valve connected above the casing, and grease injectors at the top of the wellhead which receive any lines passing up out of the wellhead.

9. The jet drilling system of claim 8 further comprising:

the upper body housing a downhole motor having a shaft and the lower body being attached to the upper body for rotation under control of the downhole motor; and a motor controller connected via a communication link to the downhole motor.

10. The jet drilling apparatus of claim 7 in which the hose carries a flexible perforated liner.

11. The jet drilling apparatus of claim 10 in which the flexible perforated liner is secured on the hose by shoulders at opposed ends of the flexible perforated liner which engage with shoulders on the jet head.

12. A jet drilling device, comprising a jet drilling hose having a downhole end;

a jet head on the downhole end of the jet drilling hose; and a flexible perforated liner carried by the jet drilling hose.

13. The jet drilling device of claim 12 in which the flexible perforated liner is secured on the hose by shoulders at opposed ends of the flexible perforated liner which engage with shoulders on the jet head.

14. A method of drilling lateral wells from a main well, the method comprising the steps of:

locating an orientable jet drilling apparatus in a well, the orientable jet drilling apparatus having an angled elbow for directing a jet drilling head laterally from the orientable jet drilling apparatus;

drilling a first lateral well with the jet drilling head at a first radial position;

removing the jet drilling head from the first lateral well;

rotating the orientable jet drilling apparatus with a motor mounted on the orientable jet drilling apparatus to a second radial position; and drilling a second lateral well at the second radial position with the jet drilling head.

15. The method of claim 14 further comprising the steps of:

while drilling the first lateral well, pulling a flexible perforated liner into the first lateral well with the jet drilling head; and while removing the jet drilling head from the first lateral well, leaving a portion of the flexible perforated liner in the first lateral well after completion of the first lateral well.

16. The method of claim 15 further comprising the step of:

shearing the flexible perforated liner by rotating the orientable jet drilling apparatus to cut off the portion of the flexible perforated liner.

17. A method of drilling lateral wells from a main well, the method comprising the steps of:

locating an orientable jet drilling apparatus in a well, the orientable jet drilling apparatus having an angled elbow for directing a jet drilling head laterally from the orientable jet drilling apparatus;

drilling a first lateral well with the jet drilling head at a first radial position;

pulling a flexible perforated liner into the first lateral well with the jet drilling head; and removing the jet drilling head from the formation while leaving a portion of the flexible perforated liner in the first lateral well after completion of the first lateral well.

18. The method of claim 17 further comprising the step of:

rotating the orientable jet drilling apparatus to a second radial position; and drilling a second lateral well at the second radial position with the jet drilling head.

19. The method of claim 17 further comprising the step of:

shearing the flexible perforated liner by rotating the orientable jet drilling apparatus to cut off the portion of the flexible perforated liner in the first lateral well.

20. A method of drilling lateral wells from a main well, the method comprising the steps of:

locating an orientable jet drilling apparatus in a well, the orientable jet drilling apparatus having an angled elbow for directing a jet drilling head laterally from the orientable jet drilling apparatus;

drilling a lateral well using a fluid selected from the group consisting of carbon dioxide, hydrocarbon fluids and miscible mixtures thereof with the jet drilling head at a first radial position; and removing the jet drilling head from the formation.

* * * * *